US007899382B2

(12) United States Patent
Hozumi et al.

(10) Patent No.: US 7,899,382 B2
(45) Date of Patent: Mar. 1, 2011

(54) LUBRICANT SUPPLIER, PROCESS CARTRIDGE INCLUDING SAME, AND IMAGE FORMING APPARATUS INCLUDING SAME

(75) Inventors: Yoshiki Hozumi, Sagamihara (JP); Kazuhiko Watanabe, Machida (JP); Takeshi Saitoh, Hachioji (JP)

(73) Assignee: Ricoh Company Limited, Tokyo (JP)

( * ) Notice: Subject to any disclaimer, the term of this patent is extended or adjusted under 35 U.S.C. 154(b) by 273 days.

(21) Appl. No.: 12/109,648

(22) Filed: Apr. 25, 2008

(65) Prior Publication Data

US 2009/0010692 A1 Jan. 8, 2009

(30) Foreign Application Priority Data

May 7, 2007 (JP) ..... 2007-122581

(51) Int. Cl.
*G03G 21/00* (2006.01)

(52) U.S. Cl. ..... 399/346; 399/350; 399/351

(58) Field of Classification Search ..... 399/346, 399/350, 351
See application file for complete search history.

(56) References Cited

U.S. PATENT DOCUMENTS

| | | | | |
|---|---|---|---|---|
| 7,103,301 | B2 | 9/2006 | Watanabe et al. | |
| 7,184,699 | B2 | 2/2007 | Naruse et al. | |
| 7,251,438 | B2 | 7/2007 | Watanabe et al. | |
| 2005/0058474 | A1 | 3/2005 | Watanabe et al. | |
| 2005/0254868 | A1 | 11/2005 | Naruse et al. | |
| 2006/0099016 | A1 | 5/2006 | Watanabe et al. | |
| 2006/0165450 | A1 | 7/2006 | Koike et al. | |
| 2006/0285898 | A1 | 12/2006 | Watanabe et al. | |
| 2007/0003337 | A1* | 1/2007 | Shakuto et al. | 399/349 |
| 2007/0059067 | A1* | 3/2007 | Tanaka et al. | 399/346 |
| 2007/0123435 | A1* | 5/2007 | Usami | 508/100 |
| 2007/0242992 | A1 | 10/2007 | Watanabe et al. | |
| 2008/0253801 | A1* | 10/2008 | Hatakeyama et al. | 399/113 |

FOREIGN PATENT DOCUMENTS

| | | |
|---|---|---|
| JP | 2000-330443 | 11/2000 |
| JP | 2001-305907 | 11/2001 |
| JP | 2004-272019 | 9/2004 |
| JP | 2005-227676 | 8/2005 |
| JP | 2006-154747 | 6/2006 |

* cited by examiner

*Primary Examiner*—David M Gray
*Assistant Examiner*—Rodney Bonnette
(74) *Attorney, Agent, or Firm*—Oblon, Spivak, McClelland, Maier & Neustadt, L.L.P.

(57) ABSTRACT

A lubricant supplier, installable in a process cartridge or an image forming apparatus, includes a ridge line extending crosswise to a longitudinal axis of the image forming member and contacting the surface of the image forming member at a non-perpendicular angle to the longitudinal axis of the image forming member, a first face opposed to the image forming member and located upstream from a contact portion of the ridge line and the surface of the image forming member in a direction of movement of the surface of the image forming member, and a second face opposed to the image forming member and located downstream from the contact portion in the direction of movement of the surface of the image forming member. The first face and the second face intersect at the ridge line and form an obtuse angle therebetween.

7 Claims, 4 Drawing Sheets

LUBRICANT SUPPLIER, PROCESS CARTRIDGE INCLUDING SAME, AND IMAGE FORMING APPARATUS INCLUDING SAME

CROSS-REFERENCE TO RELATED APPLICATIONS

The present patent application claims priority under 35 U.S.C. §119 from Japanese Patent Application No. 2007-122581, filed on May 7, 2007 in the Japan Patent Office, the contents and disclosure of which are hereby incorporated by reference herein in their entirety.

BACKGROUND OF THE INVENTION

1. Field of the Invention

Exemplary embodiments of the present invention generally relate to a lubricant supplier, a process cartridge including the lubricant supplier, and an image forming apparatus including the lubricant supplier, and more particularly, to a lubricant supplier having a lubricant regulating blade regulating a layer of lubricant supplied to a surface of an image forming member, a process cartridge including the lubricant supplier, and an image forming apparatus including the lubricant supplier.

2. Discussion of the Related Art

Related-art electrophotographic image forming apparatuses generally use a cleaning device to remove residual toner remaining on a surface of an image bearing member after a toner image formed on the surface of the image bearing member is transferred onto an image receiving member or a recording medium. By so doing, the image bearing member is cleared and ready for a subsequent image forming operation. The cleaning device generally includes an elastic cleaning blade, typically made of a material such as polyurethane rubber, which has a simple structure and sufficient performance in toner removal.

To reduce a coefficient of friction between the cleaning blade and the surface of the image bearing member, some related-art electrophotographic image forming apparatuses further include a lubricant supplier that supplies lubricant such as fatty acid composed of metal salts onto the surface of the image bearing member.

Insufficient lubrication of the surface of the image bearing member cannot reduce the coefficient of friction sufficiently, and results in, for example, curling of the edge of the cleaning blade and/or a shorter life for the image bearing member.

By contrast, excessive lubrication can contaminate components and units disposed around the image bearing member, which also causes various problems such as defective images produced when the lubricant adheres to a charging member, a developer bearing member, and the like.

Accordingly, it is important to control such a lubricant supplier so as to supply only the proper amount of lubricant to an image bearing member.

Some related-art image forming apparatuses are designed to supply lubricant to a surface of an image bearing member at a position upstream from a contact portion of a cleaning blade with respect to the image bearing member in a direction of movement of the surface of the image bearing member. Since the cleaning blade provided in such an image forming apparatus can regulate a depth of the lubricant on the surface of the image bearing member, a lubricant regulating member as such is not required in the image forming apparatus.

The above-described configuration, however, causes the lubricant, together with residual toner on the surface of the image bearing member, to enter the contact portion of the cleaning blade with respect to the image bearing member, and therefore amounts of lubricant may be uneven on different local portions on the surface of the image bearing member. Specifically, the amounts of lubricant may be uneven on the surface of the image bearing member between portions with residual toner and portions without residual toner, and therefore, the image bearing member may have portions with insufficient lubricant and portions with excess lubricant. Accordingly, some local portions on the surface of the image bearing member may be susceptible to the above-described problems.

Further, some lubricant adhering to residual toner is removed with the residual toner by the action of the above-described cleaning blade. Since it is difficult to know how much lubricant is removed with the residual toner, it is hard to control amounts of lubricant supplied to and consumed on the surface of the image bearing member, thereby causing the above-described inconvenience.

Among various techniques to eliminate the above-described disadvantages, some related-art image forming apparatuses employ techniques that provide a structure in which a lubricant supplying unit is placed at a downstream side of a contact portion of a cleaning blade in a direction of movement of a surface of an image bearing member, and a lubricant regulating member is arranged at a downstream side of the lubricant supplying unit. With the above-described structure, the surface of the image bearing member is clean before application of lubricant, and therefore the lubricant can be sufficiently applied and regulated to form a layer of uniform thickness thereon. In addition, since the lubricant may stay on the surface of the image bearing member when the residual toner is removed by the cleaning blade, an amount of supply of the lubricant and/or an amount of consumption thereof can be controlled easily.

The lubricant regulating member of these techniques is a blade type supported either in a counter manner or a trailing manner. That is, when a counter-type lubricant regulating blade is used, a supporting member that supports the counter-type lubricant regulating blade is disposed downstream in the direction of movement of the surface of the image bearing member, from a contact portion on the surface of the image bearing member where a ridge line part of the counter-type lubricant regulating blade contacts thereon. By contrast, when a trailing-type lubricant regulating blade is used, the supporting member is disposed upstream from the contact portion in the direction of movement of the surface of the image bearing member.

With increasing demand for longer-lasting, maintenance-free image forming apparatuses, it is desirable that the performance of the lubricant regulating blade is maintained throughout the life of the lubricant regulating blade so as to reduce over time the occurrence of failures or disadvantages such as adhesion of lubricant to the components and units disposed around the image bearing member.

However, when contacting the surface of the image bearing member, the lubricant regulating blade is excited to generate vibration called "self-excited vibration." The self-excited vibration exciting a lubricant regulating blade is generated by a stick-slip vibration. The stick-slip vibration is a vibration frequently repeated between a stick motion, in which the lubricant regulating blade is held in contact with the surface of the image bearing member and fully functional, and a slip motion in which the lubricant regulating blade may not be fully functional. When compared to when no stick-slip motion or vibration is generated, the contact portion of the lubricant regulating blade is more heavily abraded when the stick-slip motion or vibration is generated. Heavier abrasion of the lubricant regulating blade increases an amount of lubricant passing through the contact portion with respect to the surface of the image bearing member, which can cause an amount of lubricant applied to the surface of the image bearing member to exceed an appropriate amount, and therefore defective images can easily be produced at an early stage.

As described above, a related-art lubricant regulating blade generating the stick-slip vibration cannot reduce an amount of abrasion due to time or age, which makes it difficult to maintain the lubricant regulating blade for long, and therefore the defective images can be produced easily.

The above-described problems occur not only when the related-art lubricant regulating blade contacts the surface of the image bearing member but also when the blade contacts a different material to which lubricant is applied. That is, even when the related-art lubricant regulating blade is held in contact with a component or unit other than the image bearing member, the slip-stick vibration can be generated, the amount of abrasion can increase, an amount of lubricant adhering to the components or unit around or in the vicinity of the component contacting the related-art lubricant regulating blade also increases, and as a result, various problems can be caused.

SUMMARY OF THE INVENTION

Exemplary aspects of the present invention have been made in view of the above-described circumstances.

Exemplary aspects of the present invention provide a lubricant regulating blade that can reduce an amount of its abrasion due to time or age.

Other exemplary aspects of the present invention provide a process cartridge including the above-described lubricant regulating blade.

Other exemplary aspects of the present invention provide an image forming apparatus including the above-described lubricant regulating blade.

In one exemplary embodiment, a lubricant regulating blade that regulates a height of a layer of lubricant applied onto a surface of an image forming member includes a ridge line extending crosswise to a longitudinal axis of the image forming member and configured to contact the surface of the image forming member in a manner intersecting in the longitudinal axis of the image forming member, a first face opposed to the surface of the image forming member and located upstream from a contact portion of the ridge line and the surface of the image forming member in a direction of movement of a surface of the image forming member, and a second face opposed to the surface of the image forming member and located downstream from the contact portion of the ridge line and the surface of the image forming member in the direction of movement of the surface of the image forming member. With the above-described configuration, the first face and the second face intersect at the ridge line, and an inner surface of the first face and an inner surface of the second face form an obtuse angle therebetween.

The obtuse angle of the ridge line ranges from approximately 95 degrees to approximately 140 degrees.

Further, in one exemplary embodiment, a process cartridge that is detachable with respect to an image forming apparatus includes an image bearing member configured to bear an image on a surface thereof, and a lubricant supplier configured to supply lubricant to the image bearing member and includes the above-described lubricant applicator.

Further, in one exemplary embodiment, an image forming apparatus includes an image bearing member configured to bear an image on a surface thereof, a charging device configured to uniformly charge the surface of the image bearing member, an optical writing device configured to optically form a latent image on the surface of the image bearing member charged by the charging device, a developing device configured to develop the latent image formed on the surface of the image bearing member to a visible toner image, a transfer device configured to transfer the toner image onto an image receiving member, and a lubricant supplier configured to supply lubricant to the image bearing member and includes the above-described lubricant applicator.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
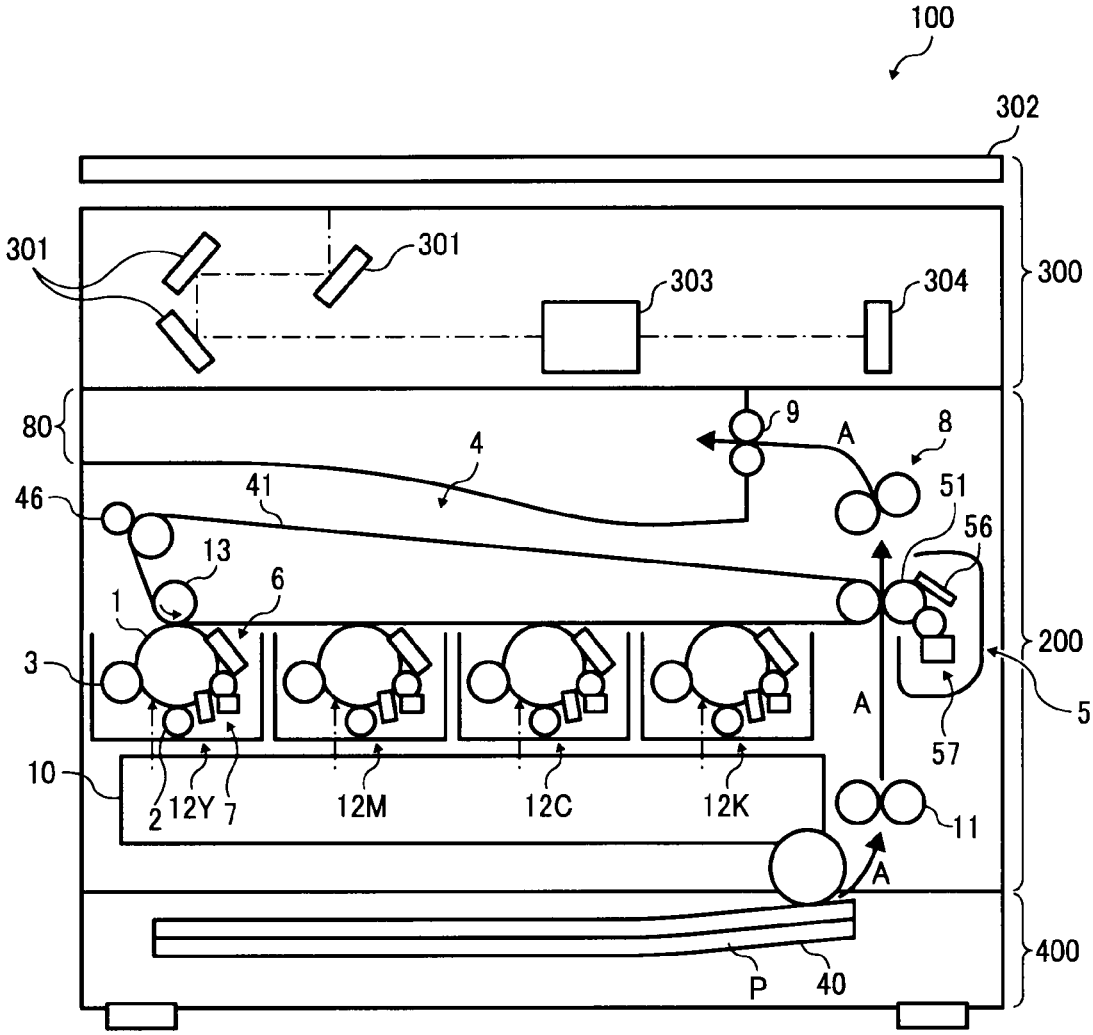
FIG. 1 is a schematic configuration of an internal portion of an image forming system according to at least one exemplary embodiment of the present invention.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Referring now to the drawings, wherein like reference numerals designate identical or corresponding parts throughout the several views, preferred embodiments of the present invention are described.

Referring now to the drawings, wherein like reference numerals designate identical or corresponding parts throughout the several views, preferred embodiments of the present invention are described.

Referring to FIG. 1, a schematic configuration of a full-color image forming apparatus 100 according to one exemplary embodiment of the present invention is described.

The full-color image forming apparatus 100 of FIG. 1 employs a so-called in-body sheet discharge system having an in-body sheet discharging part 80, and includes an image forming mechanism 200, an image reading mechanism 300, and a sheet feeding mechanism 400.

A path indicated by arrow "A" in FIG. 1 shows a paper path where a recording paper P travels in the full-color image forming apparatus 100.

The image forming mechanism 200 is located at a substantially center portion of the full-color image forming apparatus 100, and includes four image forming devices 12Y, 12M, 12C, and 12K, an intermediate transfer device 4, and an optical writing device 10.

The image forming devices 12Y, 12M, 12C, and 12K are provided for forming respective images of specific colors, which are yellow (Y), magenta (M), cyan (C), and black (K).

The intermediate transfer device 4 is located at a position above the image forming devices 12Y, 12M, 12C, and 12K, and includes an intermediate transfer belt 41 that forms an endless belt member.

The optical writing device 10 is located at a position below the image forming devices 12Y, 12M, 12C, and 12K. The optical writing device 10 emits respective laser light beams as indicated by dash and dotted lines shown in FIG. 1, so as to optically form respective electrostatic latent images of specific colors.

Since the four image forming devices 12Y, 12M, 12C, and 12K have similar structures and functions, except that respective toners are of different colors. Therefore, hereinafter, the explanations omit the suffixes indicating specific colors when not necessary to distinguish the colors of toners.

The image forming device 12 includes a photoconductor 1 serving as a drum-shaped image bearing member, and receives a laser light beam from the optical writing device 10 to form an electrostatic latent image on a surface thereof.

Around the photoconductor 1, various image forming components are disposed. For example, a charging device 2, a developing device 3, a photoconductor cleaning device 6, a lubricant supplier 7, a fixing device 8, and so forth are disposed around the photoconductor 1.

The charging device 2 uniformly charges the surface of the photoconductor 1.

The developing device 3 develops the electrostatic latent image formed on the surface of the photoconductor 1 to a visible toner image.

The photoconductor cleaning device 6 serves as a cleaning device to remove and collect residual toner remaining on the surface of the photoconductor 1 after the toner image formed on the surface of the photoconductor 1 is transferred onto a surface of the intermediate transfer belt 41 of the intermediate transfer device 4.

The lubricant supplier 7 supplies a given amount of lubricant onto the surface of the photoconductor 1.

Figure 2:
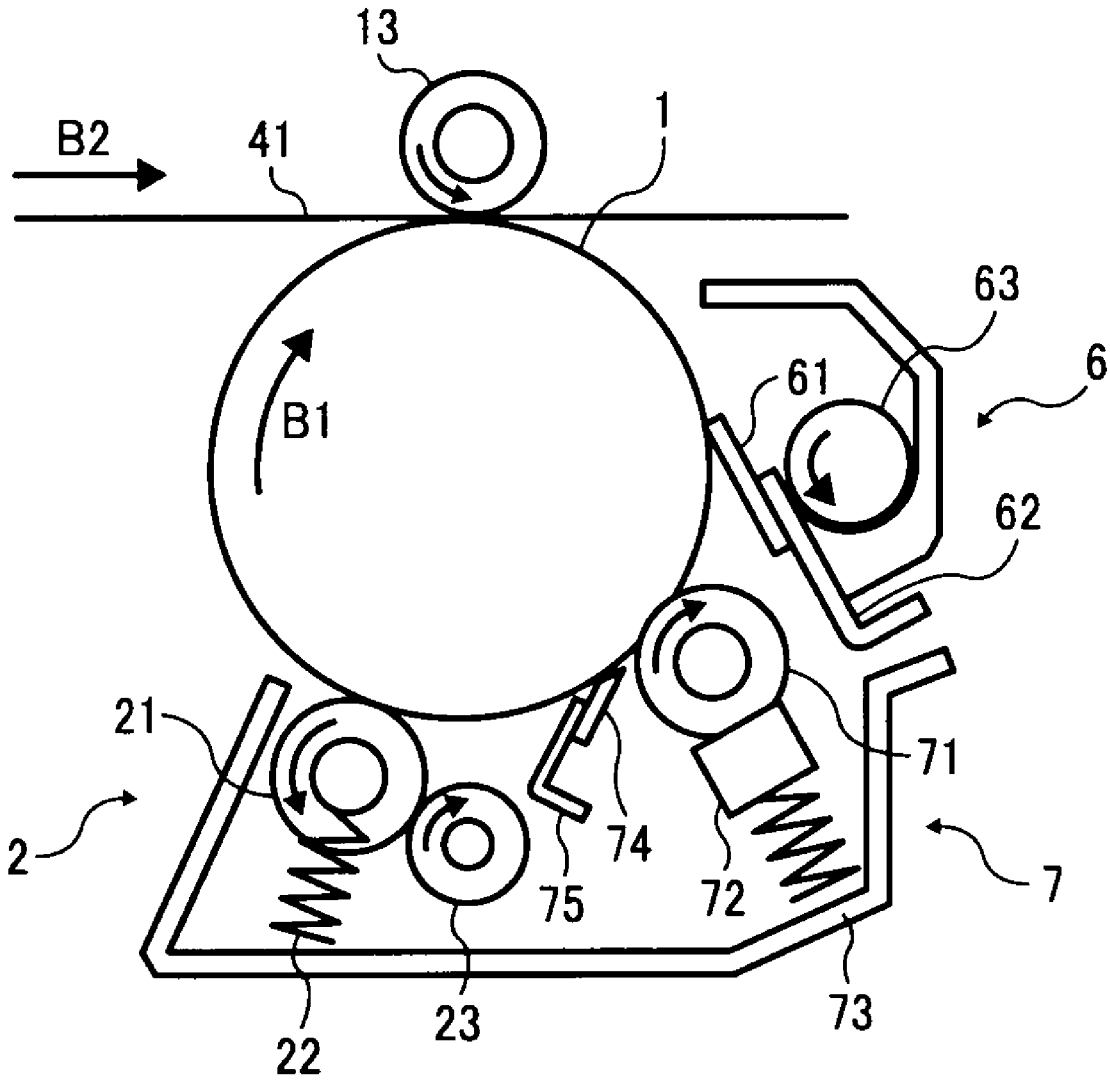
FIG. 2 is an enlarged view showing a schematic configuration of a process cartridge including an image bearing member and image forming components disposed around the image bearing member of the image forming apparatus of FIG. 1.

A primary transfer roller 13 is disposed to face the photoconductor 1 and sandwiches the intermediate transfer belt 41 with the surface of the photoconductor 1, so as to apply a given voltage to transfer the toner image from the photoconductor 1 to the intermediate transfer belt 41. The primary transfer roller 13 rotates in a counterclockwise direction as shown in FIG. 2.

A secondary transfer device 5 is disposed on the right-hand side of the intermediate transfer device 4 in FIG. 1, and includes a secondary transfer roller 51, a secondary transfer member cleaning device 56, and a secondary lubricant supplier 57.

During primary image transfer, the intermediate transfer belt 41 sequentially receives respective toner image formed on the photoconductors 1 of the image forming devices 12Y, 12M, 12C, and 12K to form an overlaid toner image. During secondary image transfer, a given voltage may be applied from the secondary transfer roller 51 of the secondary transfer device 5 so that the overlaid toner image can be transferred from the intermediate transfer belt 41 onto the recording paper P.

The secondary transfer member cleaning device 56 removes and collects residual toner remaining on the surface of the secondary transfer roller 51 so as not to contaminate the back side of the recording paper P.

The secondary lubricant supplier 57 supplies a given amount of lubricant to the secondary transfer roller 51.

The intermediate transfer device 4 includes an intermediate transfer member cleaning device 46 to remove residual toner from the surface of the intermediate transfer belt 41 after the first and second image transfer operations.

The fixing device 8 fixes the overlaid toner transferred by the secondary transfer device 5 onto the recording paper P.

After passing through the fixing device 8, the recording paper P travels through a pair of sheet discharging rollers 9 to be discharged and stacked on the in-body sheet discharging part 80.

To achieve easy maintenance, the image forming device 12 serves as a process cartridge to integrally mount the photoconductive element 1, the charging device 2, the developing device 3, the photoconductive element cleaning device 6, and the lubricant applying device 7 therein. The image forming device 12 or process cartridge can be effectively detached from the full-color image forming apparatus 100.

The sheet feeding mechanism 400 accommodates or stores unused or new recording media including the recording paper P in a sheet feeding cassette 40. To feed the recording paper P, a feed roller (not shown) is rotated to feed the recording paper P on top of the recording media accommodated in the sheet feeding cassette 40 and convey the fed recording paper P to a pair of registration rollers 11.

The pair of registration rollers 11 is controlled to temporarily stop conveyance of the recording paper P to feed the recording paper P in synchronization with movement of the intermediate transfer belt 41.

Further, additional sheet feeding device(s) can be attached, when necessary, to the bottom of the full-color image forming apparatus 100.

The image reading mechanism 300 is located at a portion above the image forming mechanism 200, sandwiching the in-body sheet discharging part 80 where the recording paper P with a fixed toner image thereon is discharged and stacked.

The image reading mechanism 300 includes moving members 301, a contact glass 302, an image forming lens 303, and a charge coupled device or CCD 304.

The moving members 301 that mount light source and mirror may move reciprocally in a longitudinal direction of the contact glass 302 so as to scan an original document (not shown) placed on the contact glass 302. The CCD 304 disposed at a subsequent stage of the image forming lens 303 receives light reflected from the original document, converts the received light into an image signal, and output a controller (not shown).

The controller performs image processing with respect to image data based on the image signal input from the CCD 304, and controls driving of a light source or laser diode of the optical writing device 10 based on the image data. A light beam emitted from the laser diode travels via a known polygon mirror and lenses and reaches the surface of the photoconductor 1 so as to form an electrostatic latent image corresponding to the image data.

Referring to FIG. 2, a schematic configuration of the photoconductor 1 and the image forming components disposed around the photoconductor 1 is described according to one exemplary embodiment of the present invention.

In FIG. 2, the developing device 3 is not depicted. Arrow "B1" indicates a rotation direction of the photoconductor 1, and arrow "B2" indicates a direction of movement of the intermediate transfer belt 41.

The charging device 2 includes a charging roller 21, a pressure spring 22, and a charge cleaner roller 23.

The charging roller 21 serves as a charging member, and includes a conductive elastic layer covering a conductive shaft. A given voltage generated by a voltage applying device (not shown) is applied to the charging roller 21 via the conductive shaft thereof, so that a given voltage generated in a space between the conductive elastic layer and the photoconductor 1 may apply charge at a given polarity to the surface of the photoconductor 1. The charging roller 21 rotates in a counterclockwise direction as indicated by an arrow shown in FIG. 2.

The pressure spring 22 serves as a charge biasing member to provide a given pressure to the photoconductor 1.

The charge cleaner roller 23 serves as a cleaning member, and removes foreign material adhering to the charging roller 21. The charge cleaner roller 23 rotates in a clockwise direction as indicated by an arrow shown in FIG. 2.

A developer type may be either one-component or two-component. The developing device 3 according to one exemplary embodiment of the present invention employs two-component developer.

The developing device 3 agitates the developer sufficiently by an agitating screw, conveys the agitated developer to a developing roller serving as a developer bearing member to cause the developer to be born magnetically, and a development doctor serving as a developer regulating member regulates a height or thickness of the developer carried on the developing roller to form a thin layer. By rotating the developing roller, the developer formed in a thin layer is conveyed to an area opposed to the photoconductor 1 or a development area where the electrostatic latent image formed on the surface of the photoconductor 1 is developed to a toner image.

The photoconductor cleaning device 6 includes a cleaning blade 61, a cleaning blade holder 62, and a toner collection coil 63.

The cleaning blade 61 serves as a cleaning member, and rotates in a counterclockwise direction as indicated by an arrow shown in FIG. 2. The cleaning blade 61 is supported by the cleaning blade holder 62 at a position downstream in a direction of movement of a surface of the photoconductor 1, from a contact portion where a ridge line of the cleaning blade 61 contacts the surface of the photoconductor 1. Accordingly, the cleaning blade 61 of the full-color image forming apparatus 100 according to an exemplary embodiment of the present invention is supported in a counter manner.

The toner collection coil 63 rotates in a counterclockwise direction as indicated by an arrow shown in FIG. 2, and collects residual toner scraped by the cleaning blade 61 to convey to a used toner bottle (not shown).

The lubricant supplier 7 according to an exemplary embodiment of the present invention is disposed downstream from the photoconductor cleaning device 6 and upstream of the charging device 2 in the direction of movement of the surface of the photoconductor 1, and includes a brush roller 71, a solid lubricant 72, a pressure spring 73, a lubricant regulating blade 74, and a regulating blade holder 75.

The solid lubricant 72 includes zinc stearate and is held in contact with the brush roller 71. Other than zinc stearate, the solid lubricant 72 used in the full-color image forming apparatus 100 can alternatively include any appropriate material.

The pressure spring 73 helps the solid lubricant 72 to press contact to the brush roller 71.

The brush roller 71 serves as a roller-type lubricant applicator, and includes a metallic shaft with brush member rolled or twisted therearound to cause the brush member to scrape lubricant powder from the solid lubricant 72 and apply the lubricant powder onto the surface of the photoconductor 1. The brush roller 71 is held in contact with the solid lubricant 72, as described above, and with the surface of the photoconductor 1, and rotates in a clockwise direction as indicated by an arrow shown in FIG. 2, which is a counter direction of the rotation direction of the photoconductor 1.

The lubricant regulating blade 74 is supported by the regulating blade holder 75, details of which will be described later.

Figure 3A:
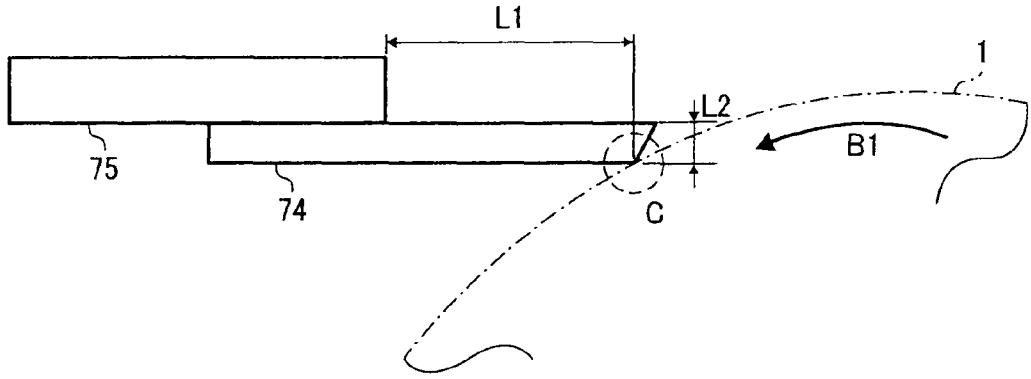
FIG. 3A is a cross-sectional view of a lubricant regulating blade contacting the image bearing member of FIG. 2.
Figure 3B:
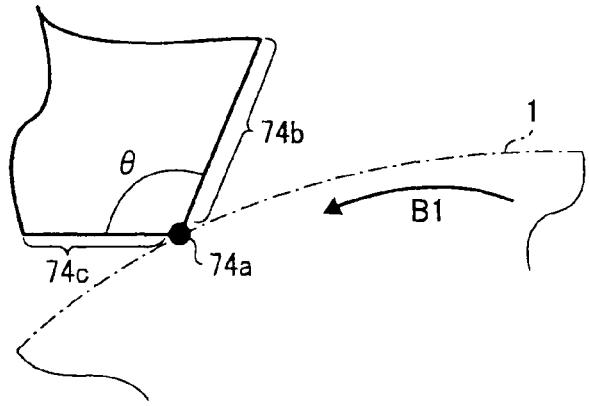
FIG. 3B is a cross-sectional enlarged view of the lubricant regulating blade of FIG. 3A.

Referring to FIGS. 3A and 3B, a detailed description is given of the lubricant regulating blade 74 according to an exemplary embodiment of the present invention. FIG. 3A is a cross-sectional view of the lubricant regulating blade 74 that is held in contact with the surface of the photoconductor 1, and FIG. 3B is a cross-sectional enlarged view of area C in FIG. 3A where the lubricant regulating blade 74 contacts the photoconductor 1.

The lubricant regulating blade 74 of the lubricant supplier 7 is held in contact with the surface of the photoconductor 1 and is disposed downstream in the direction of movement of the surface of the photoconductor 1, from a contact portion of the brush roller 71 with respect to the photoconductor 1. The lubricant regulating blade 74 is made of polyurethane rubber, and supported in a manner of the counter-type blade. That is, the regulating blade holder 75 supports the lubricant regulating blade 74 downstream in the direction of movement of the surface of the photoconductor 1, from a contact portion of the lubricant regulating blade 74 with respect to the photoconductor 1, and more specifically from a point where a ridge line 74*a* of the lubricant regulating blade 74 contacts the surface of the photoconductor 1 in the direction of movement of the surface of the photoconductor 1, as shown in FIG. 3B. By so doing, the lubricant regulating blade 74 supported in a counter blade manner can apply a contact pressure greater than the lubricant regulating blade 74 supported in a trailing blade manner. Therefore, when granulated lubricant comes to the contact portion of the lubricant regulating blade 74 and the photoconductor 1, the lubricant regulating blade 74 can surely block and hold the granulated lubricant entering to the contact portion of the lubricant regulating blade 74 and the surface of the photoconductor 1 to effectively regulate an amount of the granulated lubricant to be applied on the surface of the photoconductor 1. That is, an excess amount of lubricant can be stopped at the lubricant regulating blade 74 and prevented from falling or adhering to the other image forming components. Further, the lubricant regulating blade 74 can also block and hold residual toner that has passed the cleaning blade 61, and therefore, production of defect images due to such an excess amount of residual toner can be prevented.

An advantage of the lubricant regulating blade 74 according to an exemplary embodiment of the present invention is to contact with the surface of the photoconductor 1 at an obtuse angle forming the ridge line 74*a*. Specifically, the ridge line 74*a* has an angle "θ" formed by two faces 74*b* and 74*c* of the lubricant regulating blade 74, and the angle "θ" is an obtuse angle. That is, the angle "θ" of the ridge line 74*a* that is formed between the two faces 74*b* and 74*c* of the lubricant regulating blade 74 is obtuse. Hereinafter, the angle "θ" of the ridge line 74*a* is referred to as a "ridge line angle."

The face 74*b* of the lubricant regulating blade 74 is located upstream from the contact portion in the direction of movement of the surface of the photoconductor 1, the face 74*c* of the lubricant regulating blade 74 is located downstream from the contact portion in the direction of movement of the surface of the photoconductor 1, and the ridge line angle "θ" sandwiched by respective backsides of the faces 74*b* and 74*c* is an obtuse angle.

It is preferable that the ridge line angle "θ" is in a range of from approximately 95 degrees to approximately 140 degrees.

When the ridge line angle "θ" is less than 95 degrees, the stick-slip vibration cannot effectively be reduced with the obtuse angle. By contrast, when the ridge line angle "θ" is greater than 140 degrees, a necessary contact pressure cannot be sufficiently applied to the photoconductor 1. Accordingly, the inventors of the present invention have employed the ridge line angle "θ" of approximately 120 degrees in an exemplary embodiment of the present invention as a preferable angle of the ridge line 74*a*.

The above-described preferable values and range of the ridge line angle "θ" were determined according to the following tests for evaluating effects on abrasion of the ridge line 74*a* of the lubricant regulating blade 74 with time when the ridge line angle "θ" was determined to be an obtuse angle.

Figure 4:
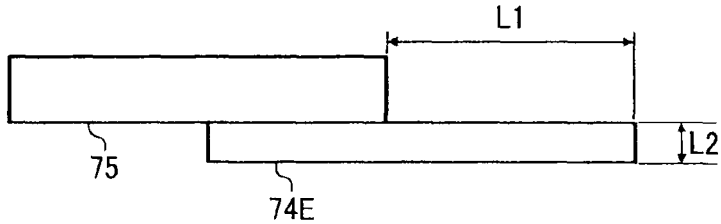
FIG. 4 BACKGROUND ART
FIG. 4 is a cross-sectional view of a lubricant regulating blade used as a comparative example in tests conducted by the inventors of the present invention.

Through the above-described tests, the lubricant regulating blade 74 of FIG. 3A was used under conditions that a free end length L1 of the lubricant regulating blade 74 is approximately 6 mm and a thickness L2 thereof is approximately 1.3 mm. For a comparative example, a lubricant regulating blade 74E of FIG. 4, which is a known regulating blade, was used. The lubricant regulating blade 74E includes identical conditions to the lubricant regulating blade 74 except that a ridge line angle thereof is approximately 90 degrees.

The inventors conducted the running tests with these lubricant regulating blades 74 and 74E to evaluate images printed on respective given amounts of sheets visually, determine whether each image has defects therein, specifically black streams in this case, and rank the results. Black streams may be generated in image mainly due to adhesion of lubricant to the charging roller 21.

Table 1 below shows the results of the above-described tests. In Table 1, "GOOD" represents the inventors' judgment that no black streaks were found in image, and "OCCASIONALLY GOOD" represents that black streams were found in halftone image.

TABLE 1

| No. of Sheets | Angle at Ridge Line Part of Lubricant Regulating Blade | |
|---|---|---|
| Printed | 120 degrees | 90 degrees |
| 10,000 sheets | GOOD | GOOD |
| 20,000 sheets | GOOD | GOOD |
| 30,000 sheets | GOOD | GOOD |
| 40,000 sheets | GOOD | GOOD |
| 50,000 sheets | GOOD | GOOD |
| 60,000 sheets | GOOD | GOOD |
| 70,000 sheets | GOOD | GOOD |
| 80,000 sheets | GOOD | OCCASIONALLY GOOD |
| 90,000 sheets | GOOD | OCCASIONALLY GOOD |
| 100,000 sheets | GOOD | OCCASIONALLY GOOD |
| 110,000 sheets | GOOD | OCCASIONALLY GOOD |
| 120,000 sheets | OCCASIONALLY GOOD | OCCASIONALLY GOOD |

In a comparative example with the lubricant regulating blade 74E having the ridge line angle of 90 degrees, defect halftone images were produced initially at the end of printing 80,000 sheets, and continued until the end of printing 120,000 sheets.

In an example with the lubricant regulating blade 74, according an exemplary embodiment of the present invention, having the ridge line angle of 120 degrees, defect halftone images were produced at the end of printing 120,000, which ranked "OCCASIONALLY GOOD".

According to the above-described results, the inventors of the present invention found that the lubricant regulating blade 74 having the ridge line angle of 120 degrees increased its life by 1.5 times as the lubricant regulating blade 74E having the ridge line angle of 90 degrees.

In addition, the inventors of the present invention measured respective amounts of abrasion at the ridge lines of the lubricant regulating blades 74 and 74E after 120,000 sheets were printed, and found that the amount of abrasion of the lubricant regulating blade 74 having the ridge line angle of 120 degrees was approximately half as that of the lubricant regulating blade 74E having the ridge line angle of 90 degrees.

Consequently, the above-described results show that the lubricant regulating blade 74 having the ridge line angle of 120 degrees was less abraded than the lubricant regulating blade 74E having the ridge line angle of 90 degrees. Thus, it is contemplated that the charging roller 21 can be less contaminated and can delay occurrence of defect images. Further, unevenness of time-related abrasion in the longitudinal direction of the lubricant regulating blade 74, which is a longitudinal axis of the photoconductor 1, was also reduced.

Accordingly, the inventors have found through the study that a lubricant regulating blade having the ridge line angle of 95 degrees or greater can achieve a similar effect to the lubricant regulating blade 74 having the ridge line angle of 120 degrees, and can also achieve an effect to reduce more amount of abrasion than a lubricant regulating blade having the ridge line angle of 90 degrees.

Further, the inventors have found that the lubricant regulating blade with the ridge line angle of 95 degrees or greater also can reduce unevenness of time-related abrasion in the longitudinal direction thereof or an axial direction of the photoconductor 1.

However, when the ridge line angle exceeds 140 degrees, it may be difficult to obtain a contact pressure necessary for a lubricant regulating blade with respect to the surface of the photoconductor 1, which may become difficult for the lubricant regulating blade to fulfill its original function. Therefore, it is preferable that a lubricant regulating blade forms its ridge line angle up to 140 degrees.

As described above, the lubricant regulating blade 74 having the ridge line angle of 120 degrees has achieved a greater reduction of abrasion amount than the lubricant regulating blade 74E having the ridge line angle of 90 degrees. The reason of this achievement is that the use of the lubricant regulating blade 74 with an obtuse angle has reduced the stick-slip vibration that was generated in the lubricant regulating blade 74E with the 90-degree ridge line angle, and consequently, reduced the amount of time-related abrasion.

As described above, the lubricant regulating blade 74 according to at least one exemplary embodiment of the present invention employs a counter-type blade. The present invention, however, can apply to a trailing-type blade as shown in FIGS. 5 and 6.

Figure 5:
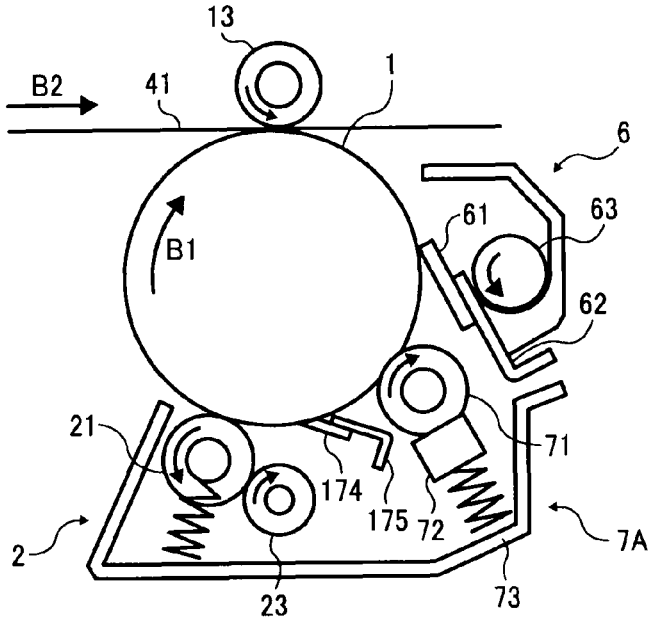
FIG. 5 is a schematic structure of a process cartridge with a trailing-type lubricant regulating blade according to an exemplary embodiment of the present invention.
Figure 6:
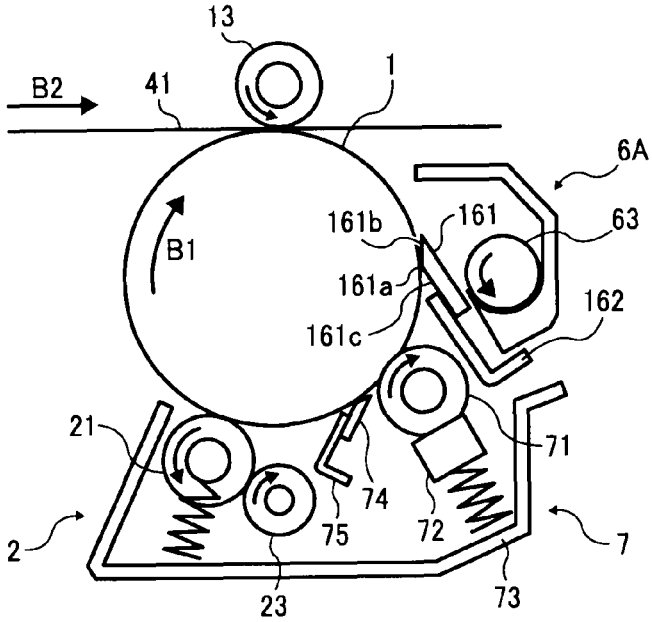
FIG. 6 is a schematic structure of a process cartridge with a trailing-type cleaning blade according to an exemplary embodiment of the present invention.

FIG. 5 shows a schematic configuration of the photoconductor 1 and the image forming components disposed around the photoconductor 1 according to one exemplary embodiment or a modified exemplary embodiment of the present invention. The configuration of the photoconductor 1 and the image forming components of FIG. 5 is similar to that of FIG. 2, except that a lubricant supplier 7A is disposed instead of the lubricant supplier 7.

Elements and members having the same functions and shapes are denoted by the same reference numerals throughout the present invention and redundant descriptions are omitted. That is, the elements and members shown in FIG. 5 corresponding to those shown in FIG. 2 are denoted by the same reference numerals, and descriptions thereof are omitted or summarized. Although not particularly described, configurations of the photoconductor 1 and the image forming components shown in FIG. 5, and operations that are not particularly described in this exemplary embodiment are the same as the photoconductor 1 and the image forming components with reference to FIG. 2.

In FIG. 5, the lubricant supplier 7A includes the brush roller 71, the solid lubricant 72, the pressure spring 73, a lubricant regulating blade 174 with an obtuse contact angle and a regulating holder 175. The lubricant supplier 7A, and causes the lubricant holder 175 to support the lubricant regulating blade 174 at an upstream side, in the direction of movement of the surface of the photoconductor 1, from the contact portion where the ridge line of the lubricant regulating blade 174 contacts the surface of the photoconductor 1. In this case, the lubricant regulating blade 174 is disposed in a trailing manner. However, by employing an obtuse angle for the lubricant regulating blade 174 to contact with the surface of the photoconductor 1, the lubricant regulating blade 174 can achieve a same effect as the lubricant regulating blade 74 of FIG. 2 disposed in a counter manner.

Further, FIG. 6 shows a schematic configuration of the photoconductor 1 and the image forming components disposed around the photoconductor 1 according to one exemplary embodiment or a modified exemplary embodiment of the present invention. The configuration of the photoconductor 1 and the image forming components of FIG. 6 is similar to that of FIG. 2, except that a photoconductor cleaning device 6A is disposed instead of the photoconductor cleaning device 6.

As previously described, the elements and members shown in FIG. 6 corresponding to those shown in FIG. 2 are denoted by the same reference numerals, and descriptions thereof are omitted or summarized. Although not particularly described, configurations of the photoconductor 1 and the image forming components shown in FIG. 6, and operations that are not particularly described in this exemplary embodiment are the same as the photoconductor 1 and the image forming components with reference to FIG. 2.

In FIG. 6, the photoconductor cleaning device 6A includes a cleaning blade 161 with an obtuse contact angle, a cleaning blade holder 162, and the toner collection coil 63. The cleaning blade 161 includes a ridge line 161*a* and two faces 161*b* and 161*c* forming a ridge line angle at the ridge line 161*a* of the cleaning blade 161.

According to the same reason as the lubricant regulating blade 74 of FIG. 2, the cleaning blade 161 of FIG. 6 having an obtuse ridge line angle can reduce the amount of abrasion with time.

Same as the lubricant regulating blade 74 or 174, a preferable range of the ridge line angle of the cleaning blade 161 is from approximately 95 degrees to approximately 140 degrees. When the ridge line angle of the cleaning blade 161 exceeds 140 degrees, cleaning ability may deteriorate to result in defective cleaning operation.

In at least one exemplary embodiment of the present invention, the advantageous shape and functions of the lubricant regulating blade 74 that regulated lubricant applied on the surface of the photoconductor 1 are described. However, the present invention can apply any lubricant regulating blade that is used for supplying or applying lubricant to the intermediate transfer belt 41, the secondary transfer roller 51, or the like so as to achieve the same effect as the lubricant regulating blade 74.

Next, the toner used in the full-color image forming apparatus 100 according to an exemplary embodiment of the present invention is described.

It is preferable that the toner according to an exemplary embodiment of the present invention has an average circularity of from approximately 0.93 to approximately 1.00.

The circularity "a" of a toner particle of the toner is determined by the following equation:

$$a=L0/L,$$

where "L0" represents the length of the circumference of the projected image of a toner particle, and "L" represents the length of the circumference of a circle having the same area as that of the projected image of the toner particle.

The circularity "a" is an index of degree of smooth surface and rough surface of a toner particle. As the shape of a toner particle is close to a truly spherical shape, the value of circularity becomes close to 1.00. By contrast, as the surface shape of a toner particle is more complex, the value of circularity becomes a smaller value.

Preferably, the toner particle has an average circularity of from approximately 0.93 to approximately 1.00, where the toner particle may have a smooth surface. Further, a contact area between toner particles and between the toner particle and the photoconductor 1 is small, which may have high transfer ability.

On the other hand, when the cleaning unit 6 employs a blade-type member, a toner particle having a high circularity may easily enter into a gap between the photoconductor 1 and the cleaning blade 61 to fall from the gap and contaminate the charging roller 21 easily. However, by employing the lubricant regulating blade 74 according to at least one exemplary embodiment of the present invention, the blade abrasion can be prevented, and thereby reducing a production of defect images due to the contamination of the charging roller 21.

The preferred toner for use in an image forming apparatus according to the present invention is produced through bridge reaction and/or elongation reaction of a liquid toner material in aqueous solvent. Here, the liquid toner material is generated by dispersing polyester prepolymer including an aromatic group having at least nitrogen atom, polyester, a coloring agent, and a release agent in organic solvent. In the following, toner constituents and a toner manufacturing method are described in detail.

(Polyester)

Polyester is produced by the condensation polymerization reaction of a polyhydric alcohol compound with a polyhydric carboxylic acid compound.

A polyalcohol (PO) compound may be divalent alcohol (DIO) and tri- or more valent polyalcohol (TO). Only DIO or a mixture of DIO and a small amount of TO is preferred. The divalent alcohol (DIO) may be alkylene glycol (ethylene glycol, 1,3-propylene glycol, 1,4-butanediol, 1,6-hexanediol or the like), alkylene ether glycol (diethylene glycol, triethylene glycol, dipropyrene glycol, polyethylene glycol, polypropylene glycol, polytetramethylene ether glycol or the like), alicyclic diol (1,4-cyclohexane dimethanol, hydrogenated bisphenol A or the like), bisphenols (bisphenol A, bisphenol F, bisphenol S or the like), alkylene oxide adducts of above-mentioned alicyclic diols (ethylene oxide, propylene oxide, butylene oxide or the like), and alkylene oxide adducts of the above-mentioned bisphenols (ethylene oxide, propylene oxide, butylene oxide or the like).

Alkylene glycol having 2-12 carbon atoms and alkylene oxide adducts of bisphenols are preferred. In particular, the alkylene glycol having 2-12 carbon atoms and the alkylene oxide adducts of bisphenols are preferably used together. Tri- or more valent polyalcohol (TO) may be tri- to octa or more valent polyaliphatic alcohols (glycerin, trimethylolethane, trimethylol propane, pentaerythritol, sorbitol or the like), tri- or more valent phenols (trisphenol PA, phenol novolac, cresol novolac or the like), and alkylene oxide adducts of tri- or more valent polyphenols.

The polycarboxylic acid (PC) may be divalent carboxylic acid (DIC) and tri- or more valent polycarboxylic acid (TC). Only DIC or a mixture of DIC and a small amount of TC is preferred. The divalent carboxylic acid (DIC) may be alkylene dicarboxylic acid (succinic acid, adipic acid, sebacic acid or the like), alkenylene dicarboxylic acid (maleic acid, fumaric acid or the like), and aromatic dicarboxylic acid (phthalic acid, isophthalic acid, terephthalic acid, naphthalene dicarboxylic acid or the like). Alkenylene dicarboxylic acid having 4-20 carbon atoms and aromatic dicarboxylic acid having 8-20 carbon atoms are preferred. Tri- or more valent polycarboxylic acid may be aromatic polycarboxylic acid having 9-20 carbon atoms (trimellitic acid, pyromellitic acid or the like). Here, the polycarboxylic acid (PC) may be reacted to the polyalcohol (PO) by using acid anhydrides or lower alkyl ester (methylester, ethylester, isopropylester or the like) of the above-mentioned materials.

A ratio of the polyalcohol (PO) and the polycarboxylic acid (PC) is normally set between 2/1 and 1/1 as an equivalent ratio [OH]/[COOH] of a hydroxyl group [OH] and a carboxyl group [COOH]. The ratio preferably ranges from 1.5/1 through 1/1. In particular, the ratio is preferably between 1.3/1 and 1.02/1.

In the condensation polymerization reaction of a polyhydric alcohol (PO) with a polyhydric carboxylic acid (PC), the polyhydric alcohol (PO) and the polyhydric carboxylic acid (PC) are heated to a temperature from 150° C. to 280° C. in the presence of a known esterification catalyst, e.g., tetrabutoxy titanate or dibutyltineoxide. The generated water is distilled off with pressure being lowered, if necessary, to obtain a polyester resin containing a hydroxyl group. The hydroxyl value of the polyester resin is preferably 5 or more while the acid value of polyester is usually between 1 and 30, and preferably between 5 and 20. When a polyester resin having such an acid value is used, the residual toner is easily negatively charged. In addition, the affinity of the toner for recording paper can be improved, resulting in improvement of low temperature fixability of the toner. However, a polyester resin with an acid value above 30 can adversely affect stable charging of the residual toner, particularly when the environmental conditions vary.

The weight-average molecular weight of the polyester resin is from 10,000 to 400,000, and more preferably from 20,000 to 200,000. A polyester resin with a weight-average molecular weight between 10,000 lowers the offset resistance of the residual toner while a polyester resin with a weight-average molecular weight above 400,000 lowers the temperature fixability.

A urea-modified polyester is preferably included in the toner in addition to unmodified polyester produced by the above-described condensation polymerization reaction. The urea-modified polyester is produced by reacting the carboxylic group or hydroxyl group at the terminal of a polyester obtained by the above-described condensation polymerization reaction with a polyisocyanate compound (PIC) to obtain polyester prepolymer (A) having an isocyanate group, and then reacting the prepolymer (A) with amines to crosslink and/or extend the molecular chain.

Specific examples of the polyisocyanate (PIC) include aliphatic polyisocyanate such as tetramethylenediisocyanate, hexamethylenediisocyanate and 2,6-diisocyanatemethylcaproate; alicyclic polyisocyanate such as isophoronediisocyanate and cyclohexylmethanediisocyanate; 10 aromatic diisocyanate such as tolylenedisocyanate and diphenylmethanediisocyanate; aroma aliphatic diisocyanate such as αα′α′α′-te-tramethylxylylenediisocyanate; isocyanurate; the above-mentioned polyisocyanate blocked with phenol derivatives, oxime and caprolactam; and their combinations.

The polyisocyanate (PIC) is mixed with a polyester such that the equivalent ratio ([NCO]/[OH]) between the isocyanate group [NCO] of the polyisocyanate (PIC) and the hydroxyl group [OH] of the polyester is typically from 5/1 to 1/1, preferably from 4/1 to 1.2/1 and more preferably from 2.5/1 to 1.5/1. When [NCO]/[OH] is greater than 5, low temperature fixability of the resultant toner deteriorates. When the molar ratio of [NCO] is less than 1, the urea content in the resultant modified polyester decreases and hot offset resistance of the resultant toner deteriorates.

The content of the constitutional unit obtained from a polyisocyanate (PIC) in the polyester prepolymer (A) is from 0.5% to 40% by weight, preferably from 1 to 30% by weight and more preferably from 2% to 20% by weight. When the content is less than 0.5% by weight, hot offset resistance of the resultant toner deteriorates and in addition the heat resistance and low temperature fixability of the toner also deteriorate. In contrast, when the content is greater than 40% by weight, low temperature fixability of the resultant toner deteriorates.

The number of the isocyanate groups included in a molecule of the polyester prepolymer (A) is at least 1, preferably from 1.5 to 3 on average, and more preferably from 1.8 to 2.5 on average. When the number of the isocyanate group is less than 1 per 1 molecule, the molecular weight of the urea-modified polyester decreases and hot offset resistance of the resultant toner deteriorates.

Specific examples of the amines (B) include diamines (B1), polyamines (B2) having three or more amino groups, amino alcohols (B3), amino mercaptans (B4), amino acids (B5) and blocked amines (B6) in which the amines (B1-B5) mentioned above are blocked.

Specific examples of the diamines (B1) include aromatic diamines (e.g., phenylene diamine, diethyltoluene diamine and 4,4'-diaminodiphenyl methane); alicyclic diamines (e.g., 4,4'-diamino-3,3'-dimethyldicyclohexyl methane, diamino cyclohexane and isophoron diamine); aliphatic diamines (e.g., ethylene diamine, tetramethylene diamine and hexamethylene diamine); etc. Specific examples of the polyamines (B2) having three or more amino groups include diethylene triamine, triethylene tetramine. Specific examples of the amino alcohols (B3) include ethanol amine and hydroxyethyl aniline. Specific examples of the amino mercaptan (B4) include aminoethyl mercaptan and aminopropyl mercaptan. Specific examples of amino acid (B5) are aminopropionic acid and caproic acid. Specific examples of the blocked amines (B6) include ketimine compounds which are prepared by reacting one of the amines B1-B5 mentioned above with a ketone such as acetone, methyl ethyl ketone and methyl isobutyl ketone; oxazoline compounds, etc. Among these compounds, diamines (B1) and mixtures in which a diamine is mixed with a small amount of a polyamine (B2) are preferably used.

The mixing ratio (i.e., a ratio [NCO]/[NHx]) of the content of the prepolymer (A) having an isocyanate group to the amine (B) is from 1/2 to 2/1, preferably from 1.5/1 to 1/1.5 and more preferably from 1.2/1 to 1/1.2. When the mixing ratio is greater than 2 or less than ½, molecular weight of the urea-modified polyester decreases, resulting in deterioration of hot offset resistance of the resultant toner.

Suitable polyester resins for use in the toner of the present invention include a urea-modified polyesters (i). The urea-modified polyester (i) may include a urethane bonding as well as a urea bonding. The molar ratio (urea/urethane) of the urea bonding to the urethane bonding is from 100/0 to 10/90, preferably from 80/20 to 20/80 and more preferably from 60/40 to 30/70. When the molar ratio of the urea bonding is less than 10%, hot offset resistance of the resultant toner deteriorates.

The urea modified polyester is produced by, for example, a one-shot method. Specifically, a polyhydric alcohol (PO) and a polyhydric carboxylic acid (PC) are heated to a temperature of 150° C. to 280° C. in the presence of the known esterification catalyst, e.g., tetrabutoxy titanate or dibutyltineoxide to be reacted. The resulting water is distilled off with pressure being lowered, if necessary, to obtain a polyester containing a hydroxyl group. Then, a polyisocyanate (PIC) is reacted with the polyester obtained above a temperature of from 40° C. to 140° C. to prepare a polyester prepolymer (A) having an isocyanate group. The prepolymer (A) is further reacted with an amine (B) at a temperature of from 0° C. to 140° C. to obtain a urea-modified polyester.

At the time of reacting the polyisocyanate (PIC) with a polyester and reacting the polyester prepolymer (A) with the amines (B), a solvent may be used, if necessary. Specific examples of the solvent include solvents inactive to the isocyanate (PIC), e.g., aromatic solvents such as toluene, xylene; ketones such as acetone, methyl ethyl ketone, methyl isobutyl ketone; esters such as ethyl acetate; amides such as dimethyl formamide, dimethyl acetatamide; and ethers such as tetrahydrofuran.

A reaction anticatalyst can optionally be used in the crosslinking and/or elongation reaction between the polyester prepolymer (A) and amines (B) to control a molecular weight of the resultant urea-modified polyesters, if desired. Specific examples of the reaction anticatalyst include monoamines such as diethyl amine, dibutyl amine, butyl amine and lauryl amine, and blocked amines, i.e., ketimine compounds prepared by blocking the monoamines described above.

The weight-average molecular weight of the urea-modified polyester is not less than 10,000, preferably from 20,000 to 10,000,000 and more preferably from 30,000 to 1,000,000. A molecular weight of less than 10,000 deteriorates the hot offset resisting property. The number-average molecular weight of the urea-modified polyester is not particularly limited when the after-mentioned unmodified polyester resin is used in combination. Namely, the weight-average molecular weight of the urea-modified polyester resins has priority over the number-average molecular weight thereof. However, when the urea-modified polyester is used alone, the number-average molecular weight is from 2,000 to 15,000, preferably from 2,000 to 10,000, and more preferably from 2,000 to 8,000. When the number-average molecular weight is greater than 20,000, the low temperature fixability of the resultant toner deteriorates, and in addition the glossiness of full color images deteriorates.

In the present invention, not only the urea-modified polyester alone but also the unmodified polyester resin can be included with the urea-modified polyester. A combination thereof improves low temperature fixability of the resultant toner and glossiness of color images produced by the full-color image forming apparatus 100, and using the combination is more preferable than using the urea-modified polyester alone. It is noted that the unmodified polyester may contain polyester modified by a chemical bond other than the urea bond.

It is preferable that the urea-modified polyester at least partially mixes with the unmodified polyester resin to improve the low temperature fixability and hot offset resistance of the resultant toner. Therefore, the urea-modified polyester preferably has a structure similar to that of the unmodified polyester resin.

A mixing ratio between the urea-modified polyester and polyester resin is from 20/80 to 95/5 by weight, preferably from 70/30 to 95/5 by weight, more preferably from 75/25 to 95/5 by weight, and even more preferably from 80/20 to 93/7 by weight. When the weight ratio of the urea-modified polyester is less than 5%, the hot offset resistance deteriorates, and in addition, it is difficult to impart a good combination of high temperature preservability and low temperature fixability of the toner.

The toner binder preferably has a glass transition temperature (Tg) of from 45° C. to 65° C., and preferably from 45 C.° to 60° C. When the glass transition temperature is less than 45° C., the high temperature preservability of the toner deteriorates. When the glass transition temperature is higher than 65° C., the low temperature fixability deteriorates.

Since the urea-modified polyester can exist on the surfaces of the mother toner particles, the toner of the present invention has better high temperature preservability than conventional toners including a polyester resin as a binder resin even though the glass transition temperature is low.

(Colorant)

Suitable colorants for use in the toner of the present invention include known dyes and pigments. Specific examples of the colorants include carbon black, Nigrosine dyes, black iron oxide, Naphthol Yellow S, Hansa Yellow (10G, 5G and G), Cadmium Yellow, yellow iron oxide, loess, chrome yellow, Titan Yellow, polyazo yellow, Oil Yellow, Hansa Yellow (GR, A, RN and R), Pigment Yellow L, Benzidine Yellow (G and GR), Permanent Yellow (NCG), Vulcan Fast Yellow (5G and R), Tartrazine Lake, 25 Quinoline Yellow Lake, Anthrazane Yellow BGL, isoindolinone yellow, red iron oxide, red lead, orange lead, cadmium red, cadmium mercury red, antimony orange, Permanent Red 4R, Para Red, Fire Red, p-chloro-o-nitroaniline red, LitholFast Scarlet G, Brilliant Fast Scarlet, Brilliant Carmine BS, Permanent Red (F2R, F4R, FRL, FRLL and F4RH), Fast Scarlet VD, Vulcan Fast Rubine B, Brilliant Scarlet G, Lithol Rubine GX, Permanent Red F5R, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, Indanthrene Blue (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone and the like. These materials are used alone or in combination.

A content of the colorant in the toner is preferably from 1 to 15% by weight, and more preferably from 3 to 10% by weight, based on the total weight of the toner.

The colorants mentioned above for use in the present invention can be used as master batch pigments by being combined with a resin.

The examples of binder resins to be kneaded with the master batch or used in the preparation of the master batch are styrenes like polystyrene, poly-p-chlorostyrene, polyvinyl toluene and polymers of their substitutes, or copolymers of these with a vinyl compound, polymethyl metacrylate, polybutyl metacrylate, polyvinyl chloride, polyvinyl acetate, polyethylene, polypropylene, polyester, epoxy resins, epoxy polyol resins, polyurethane, polyamides, polyvinyl butyral, polyacrylic resins, rosin, modified rosin, terpene resins, aliphatic and alicyclic hydrocarbon resins, aromatic petroleum resins, chlorinated paraffins, paraffin wax etc. which can be used alone or in combination.

(Charge Controlling Agent)

Specific examples of the charge controlling agent include known charge controlling agents such as Nigrosine dyes, triphenylmethane dyes, metal complex dyes including chromium, chelate compounds of molybdic acid, Rhodaminedyes, alkoxyamines, quaternary ammonium salts (including fluorine-modified quaternary ammonium salts), alkylamides, phosphor and compounds including phosphor, tungsten and compounds including tungsten, fluorine-containing activators, metal salts of salicylic acid, salicylic acid derivatives, etc.

Specific examples of the marketed products of the charge controlling agents include BONTRON 03 (Nigrosine dyes), BONTRON P-51 (quaternary ammonium salt), BONTRON S-34 (metal-containing azo dye), E-82 (metal complex of oxynaphthoic acid), E-84 (metal complex of salicylic acid), and E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE PSY VP2038 (quaternary ammonium salt), COPY BLUE (triphenyl methane derivative) PR, COPY CHARGE NEG VP2036 and NX VP434 (quaternary ammonium salt), which are manufactured by Hoechst AG; LRA-901, and LR-147 (boron complex), which are manufactured by Japan Carlit Co., Ltd.; copper phthalocyanine, perylene, quinacridone, azo pigments and polymers having a functional group such as a sulfonate group, a carboxyl group, a quaternary ammonium group, etc. Among these materials, materials negatively charging a toner are preferably used.

The content of the charge controlling agent is determined depending on the species of the binder resin used, whether or not an additive is added, the toner manufacturing method (such as dispersion method) used, and is not particularly limited. However, the content of the charge controlling agent is typically from 0.1 to 10 parts by weight, and preferably from 0.2 to 5 parts by weight, per 100 parts by weight of the binder resin included in the toner. When the content is too high, the toner has too large a charge quantity. Consequently, the electrostatic force of a developing roller attracting the toner increases, resulting in deterioration of the fluidity of the toner and decrease of the image density of toner images.

(Releasing Agent)

A wax for use in the toner of the present invention as a releasing agent has a low melting point of from 50° C. to 120° C. When such a wax is included in the toner, the wax is dispersed in the binder resin and serves as a releasing agent at a location between a fixing roller and the toner particles. Thereby, hot offset resistance can be improved without applying an oil to the fixing roller used. Specific examples of the releasing agent include natural waxes such as vegetable waxes, e.g., carnauba wax, cotton wax, Japan wax and rice wax; animal waxes, e.g., bees wax and lanolin; mineral waxes, e.g., ozokelite and ceresine; and petroleum waxes, e.g., paraffin waxes, microcrystalline waxes and petrolatum. In addition, synthesized waxes can also be used. Specific examples of the synthesized waxes include synthesized hydrocarbon waxes such as Fischer-Tropsch waxes and polyethylene waxes; and synthesized waxes such as ester waxes, ketone waxes and ether waxes. In addition, fatty acid amides such as 1,2-hydroxylstearic acid amide, stearic acid amide and phthalic anhydride imide; and low molecular weight crystalline polymers such as acrylic homopolymer and copolymers having a long alkyl group in their side chain, e.g., poly-n-stearyl methacrylate, poly-n-laurylmethacrylate and n-stearyl acrylate-ethyl methacrylate copolymers, can also be used.

These charge controlling agents and releasing agents can be dissolved and dispersed after being kneaded and receiving an application of heat together with a master batch pigment and a binder resin; and can be added when directly dissolved and dispersed in an organic solvent.

(External Additives)

The inorganic particulate material preferably has a primary particle diameter of from $5\times10^{-3}$ to 2 μm, and more preferably from $5\times10^{-3}$ to 0.5 μm. In addition, a specific surface area of the inorganic particulates measured by a BET method is preferably from 20 $m^2/g$ to 500 $m^2/g$. The content of the external additive is preferably from 0.01% to 5% by weight, and more preferably from 0.01% to 2.0% by weight, based on total weight of the toner.

Specific examples of the inorganic fine grains are silica, alumina, titanium oxide, barium titanate, magnesium titanate, calcium tiatanate, strontium titanate, zinc oxide, tin oxide, quartz sand, clay, mica, wollastonite, diatomaceous earth, chromium oxide, cerium oxide, red oxide, antimony trioxide, magnesium oxide, zirconium oxide, barium sulfate, barium carbonate, calcium carbonate, silicon carbide, and silicon nitride. Among them, as a fluidity imparting agent, it is preferable to use hydrophobic silica fine grains and hydrophobic titanium oxide fine grains in combination. Particularly, when such two kinds of fine grains, having a mean grain size of $5\times10^{-2}$ μm or below, are mixed together, there can be noticeably improved an electrostatic force and van del Waals force with the toner. Therefore, despite agitation effected in the developing device for implementing the desired charge level, the fluidity imparting agent does not part from the toner grains and insures desirable image quality free from spots or similar image defects. In addition, the amount of residual toner can be reduced.

Titanium oxide fine grains are desirable for environmental stability and image density stability, but tend to have lower charge start characteristics. Therefore, if the amount of titanium oxide fine particles is larger than the amount of silica fine grains, then the influence of the above side effect increases. However, so long as the amount of hydrophobic silica fine grains and hydrophobic titanium oxide fine grains is between 0.3 wt. % and 1.5 wt. %, the charge start characteristics are not noticeably impaired, i.e., desired charge start characteristics are achievable. Consequently, stable image quality is achievable despite repeated copying operations.

The toner of the present invention is produced by the following method, but the manufacturing method is not limited thereto.

[Preparation of Toner]

(1) First, a colorant, unmodified polyester, polyester prepolymer having isocyanate groups and a parting agent are dispersed into an organic solvent to prepare a toner material liquid.

The organic solvent should preferably be volatile and have a boiling point of 100° C. or below because such a solvent is easy to remove after the formation of the toner mother particles. More specific examples of the organic solvent includes one or more of toluene, xylene, benzene, carbon tetrachloride, methylene chloride, 1,2-dichloroethane, 1,1,2-trichloroethane, trichloro ethylene, chloroform, monochlorobenzene, dichloroethylidene, methyl acetate, ethyl acetate, methyl ethyl ketone, methyl isobutyl ketone, and so forth. Particularly, the aromatic solvent such as toluene and xylene; and a hydrocarbon halide such as methylene chloride, 1,2-dichloroethane, chloroform or carbon tetrachloride is preferably used. The amount of the organic solvent to be used should preferably 0 parts by weight to 300 parts by weight for 100 parts by weight of polyester prepolymer, more preferably 0 parts by weight to 100 parts by weight for 100 parts by weight of polyester prepolymer, and even more preferably 25 parts by weight to 70 parts by weight for 100 parts by weight of polyester prepolymer.

(2) The toner material liquid is emulsified in an aqueous medium in the presence of a surfactant and organic fine particles.

The aqueous medium for use in the present invention is water alone or a mixture of water with a solvent which can be mixed with water. Specific examples of such a solvent include alcohols (e.g., methanol, isopropyl alcohol and ethylene glycol), dimethylformamide, tetrahydrofuran, cellosolves (e.g., methyl cellosolve), lower ketones (e.g., acetone and methyl ethyl ketone), etc.

The content of the aqueous medium is typically from 50 to 2,000 parts by weight, and preferably from 100 to 1,000 parts by weight, per 100 parts by weight of the toner constituents. When the content is less than 50 parts by weight, the dispersion of the toner constituents in the aqueous medium is not satisfactory, and thereby the resultant mother toner particles do not have a desired particle diameter. In contrast, when the content is greater than 2,000, the manufacturing costs increase.

Various dispersants are used to emulsify and disperse an oil phase in an aqueous liquid including water in which the toner constituents are dispersed. Specific examples of such dispersants include surfactants, resin fine-particle dispersants, etc.

Specific examples of the dispersants include anionic surfactants such as alkylbenzenesulfonic acid salts, α-olefin sulfonic acid salts, and phosphoric acid salts; cationic surfactants such as amine salts (e.g., alkyl amine salts, aminoalcohol fatty acid derivatives, polyamine fatty acid derivatives and imidazoline), and quaternary ammonium salts (e.g., alkyltrimethylammonium salts, dialkyldimethylammonium salts, alkyldimethyl benzyl ammonium salts, pyridinium salts, alkyl isoquinolinium salts and benzethonium chloride); nonionic surfactants such as fatty acid amide derivatives, polyhydric alcohol derivatives; and ampholytic surfactants such as alanine, dodecyldi(aminoethyl)glycine, di(octylaminoethyle)glycine, and N-alkyl-N,N-dimethylammonium betaine.

A surfactant having a fluoroalkyl group can prepare a dispersion having good dispersibility even when a small amount of the surfactant is used. Specific examples of anionic surfactants having a fluoroalkyl group include fluoroalkyl carboxylic acids having from 2 to 10 carbon atoms and their metal salts, disodium perfluorooctanesulfonylgl-utamate, sodium 3-{omega-fluoroalkyl(C6-C11)oxy}-1-alkyl(C3-C4) sulfonate, sodium, 3-{omega-fluoroalkanoyl(C6-C8)-N-ethylamino}-1-propanesulfonate, fluoroalkyl(C11-C20) carboxylic acids and their metal salts, perfluoroalkylcarboxylic acids (7C-13C) and their metal salts, perfluoroalkyl(C4-C12) sulfonate and their metal salts, perfluorooctanesulfonic acid diethanol amides, N-propyl-N-(2-hydroxyethyl-)perfluorooctanesulfone amide, perfluoroalkyl(C6-C10) sulfoneamidepropyltrimethylammonium salts, salts of perfluoroalkyl (C6-C10)-N-ethylsulfonylglycin, monoperfluoroalkyl(C6-C16)e-thylphosphates, etc.

Specific examples of the marketed products of such surfactants having a fluoroalkyl group include SARFRON® S-111, S-112 and S-113, which are manufactured by ASAHI GLASS CO., LTD.; FLUORAD® FC-93, FC-95, FC-98 and FC-129, which are manufactured by SUMITOMO 3M LTD.; UNIDYNE® DS-101 and DS-102, which are manufactured by DAIKIN INDUSTRIES, LTD.; MEGAFACE® F-110, F-120, F-113, F-191, F-812 and F-833 which are manufactured by DAINIPPON INK AND CHEMICALS, INC.; ECTOP EF-102, 103, 104, 105, 112, 123A, 123B, 306A, 501, 201 and 204, which are manufactured by TOHCHEM PRODUCTS CO., LTD.; FUTARGENT® F-100 and F150 manufactured by NEOS; etc.

Specific examples of the cationic surfactants, which can disperse an oil phase including toner constituents in water, include primary, secondary and tertiary aliphatic amines having a fluoroalkyl group, aliphatic quaternary ammonium salts such as perfluoroalkyl(C6-C10)sulfoneamidepropyltrimethylammonium salts, benzalkonium salts, benzetonium chloride, pyridinium salts, imidazolinium salts, etc. Specific examples of the marketed products thereof include SARFRON® S-121 (manufactured by ASAHI GLASS CO., LTD.); FLUORAD® FC-135 (manufactured by SUMITOMO 3M LTD.); UNIDYNE DS-202 (manufactured by DAIKIN INDUSTRIES, LTD.); MEGAFACE® F-150 and F-824 (manufactured by DAINIPPON INK AND CHEMICALS, INC.); ECTOP EF-132 (manufactured by TOHCHEM PRODUCTS CO., LTD.); FUTARGENT® F-300 (manufactured by NEOS); etc.

Resin fine particles are added to stabilize toner source particles formed in the aqueous solvent. The resin fine particles are preferably added such that the coverage ratio thereof on the surface of a toner source particle can be within 10% through 90%. For example, such resin fine particles may be methyl polymethacrylate particles of 1 μm and 3 μm, polystyrene particles of 0.5 μm and 2 μm, poly(styrene-acrylonitrile) particles of 1 μm, commercially, PB-200 (manufactured by KAO Co.), SGP, SGP-3G (manufactured by SOKEN), technopolymer SB (manufactured by SEKISUI PLASTICS CO., LTD.), micropearl (manufactured by SEKISUI CHEMICAL CO., LTD.) or the like.

Also, an inorganic dispersant such as calcium triphosphate, calcium carbonate, titanium oxide, colloidal silica, and hydroxyapatite may be used.

Further, it is possible to stably disperse toner constituents in water using a polymeric protection colloid in combination with the inorganic dispersants and/or particulate polymers mentioned above. Specific examples of such protection colloids include polymers and copolymers prepared using monomers such as acids (e.g., acrylic acid, methacrylic acid, α-cyanoacrylic acid, α-cyanomethacrylic acid, itaconic acid, crotonic acid, fumaric acid, maleic acid and maleic anhydride), acrylic monomers having a hydroxyl group (e.g., β-hydroxyethyl acrylate, β-hydroxyethyl methacrylate, β-hydroxypropyl acrylate, (β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, N-methylolacrylamide and N-methylolmethacrylamide), vinyl alcohol and its ethers (e.g., vinyl methyl ether, vinyl ethyl ether and vinyl propyl ether), esters of vinyl alcohol with a compound having a carboxyl group (i.e., vinyl acetate, vinyl propionate and vinyl butyrate); acrylic amides (e.g, acrylamide, methacrylamide and diacetoneacrylamide) and their methylol compounds, acid chlorides (e.g., acrylic acid chloride and methacrylic acid chloride), and monomers having a nitrogen atom or an alicyclic ring having a nitrogen atom (e.g., vinyl pyridine, vinyl pyrrolidone, vinyl imidazole and ethyleneimine). In addition, polymers such as polyoxyethylene compounds (e.g., polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters); and cellulose compounds such as methyl cellulose, hydroxyethylcellulose and hydroxypropylcellulose, can also be used as the polymeric protective colloid.

The dispersion method is not particularly limited, and conventional dispersion facilities, e.g., low speed shearing type, high speed shearing type, friction type, high pressure jet type and ultrasonic type dispersers can be used. Among them, the high speed shearing type dispersion methods are preferable for preparing a dispersion including grains with a grain size of 2 μm to 20 μm. The number of rotations of the high speed shearing type dispersers is not particularly limited, but is usually 1,000 rpm (revolutions per minute) to 30,000 rpm, and preferably 5,000 rpm to 20,000 rpm. While the dispersion time is not limited, it is usually 0.1 minute to 5 minutes for the batch system. The dispersion temperature is usually 0° C. to 150° C., and preferably 40° C. to 98° C. under a pressurized condition.

(3) At the same time as the production of the emulsion, an amine (B) is added to the emulsion to be reacted with the polyester prepolymer (A) having isocyanate groups.

The reaction causes the crosslinking and/or extension of the molecular chains to occur. The elongation and/or crosslinking reaction time is determined depending on the reactivity of the isocyanate structure of the prepolymer (A) and amine (B) used, but is typically from 10 minutes to 40 hours, and preferably from 2 hours to 24 hours. The reaction temperature is typically from 0° C. to 150° C., and preferably from 40° C. to 98° C. In addition, a known catalyst such as dibutyltinlaurate and dioctyltinlaurate can be used. The amines (B) are used as the elongation agent and/or crosslinker.

(4) After the above reaction, the organic solvent is removed from the emulsion (reaction product), and the resultant particles are washed and then dried. Thus, mother toner particles are prepared.

To remove the organic solvent, the entire system is gradually heated in a laminar-flow agitating state. In this case, when the system is strongly agitated in a preselected temperature range, and then subjected to a solvent removal treatment, fusiform mother toner particles can be produced. Alternatively, when a dispersion stabilizer, e.g., calcium phosphate, which is soluble in acid or alkali, is used, calcium phosphate is preferably removed from the toner mother particles by being dissolved by hydrochloric acid or similar acid, followed by washing with water. Further, such a dispersion stabilizer can be removed by a decomposition method using an enzyme.

(5) Then a charge controlling agent is penetrated into the mother toner particles, and inorganic fine particles such as silica, titanium oxide etc. are added externally thereto to obtain the toner of the present invention.

In accordance with a well-known method, for example, a method using a mixer, the charge controlling agent is provided, and the inorganic particles are added.

Thus, a toner having a small particle size and a sharp particle size distribution can be obtained easily. Moreover, by controlling the stirring conditions when removing the organic solvent, the particle shape of the particles can be controlled so as to be any shape between perfectly spherical and rugby ball shape. Furthermore, the conditions of the surface can also be controlled so as to be any condition from a smooth surface to a rough surface such as the surface of pickled plum.

As described above, the ridge line 74*a* of the lubricant regulating blade 74 may contact the surface of the photoconductor 1 to cause the ridge line 74*a* to come across a direction to which the surface of the photoconductor 1 moves. By so doing, the lubricant regulating blade 74 that regulates lubricant applied on the surface of the photoconductor 1 has the ridge line angle θ, which is an obtuse angle formed by the two faces 74*b* and 74*c* of the lubricant regulating blade 74. More specifically, the face 74*b* of the lubricant regulating blade 74 is located upstream from the contact portion of the ridge line 74*a* and the surface of the photoconductor 1 in the direction of movement of the surface of the photoconductor 1, the face 74*c* of the lubricant regulating blade 74 is located downstream from the contact portion of the ridge line 74*a* and the surface of the photoconductor 1 in the direction of movement of the surface of the photoconductor 1, and the ridge line angle "θ" sandwiched by the respective backsides of the faces 74*b* and 74*c* is an obtuse angle. As described above, the cleaning blade having an obtuse ridge line angle can reduce the amount of abrasion with time. By so doing, unnecessary adhesion of lubricant onto the charging roller 21 or the like can be prevented and occurrence of defective images such as black streaks can be delayed or eliminated. In other words, the charging roller 21 or the like can extend the life thereof.

Especially, when the ridge line angle θ ranges from approximately 95 degrees to approximately 140 degrees, the lubricant regulating blade 74 can fulfill its original functions, as described above, and achieve the above-described effect with the ridge line angle θ having an obtuse angle.

Further, in at least one exemplary embodiment of the present invention, the regulating blade holder 75 that serves as a supporting member supports the lubricant regulating blade 74 in a counter-type blade manner downstream from the contact portion of the lubricant regulating blade 74 or from the portion where the ridge line 74*a* of the lubricant regulating blade 74 contacts the surface of the photoconductor 1 in the direction of movement of the surface of the photoconductor 1. By so doing, the lubricant regulating blade 74 contacting the surface of the photoconductor 1 in the counter-type blade manner can apply a contact pressure greater than a lubricant regulating blade contacting the photoconductor 1 in a trailing-type blade manner. Therefore, the lubricant regulating blade 74 can surely block and hold the granulated lubricant that comes to the contact portion of the lubricant regulating blade 74 and the surface of the photoconductor 1, and effectively prevent an excess amount of granulated lubricant from falling or adhering to the other image forming components or units in the full-color image forming apparatus 100. Further, even when the toner remains on the surface of the photoconductor 1 after transfer operation and passes the cleaning blade 61, the lubricant regulating blade 74 can also block and hold the residual toner, and therefore, production of defect images due to such an excess amount of toner can be prevented.

Further, in at least one exemplary embodiment of the present invention, the cleaning blade 61 or 161 may cause the ridge line 161*a* thereof to contact with the surface of the photoconductor 1 in a crosswise manner or in a direction across the direction of movement of the surface of the photoconductor 1, so that the lubricant regulating blade 74 can remove residual toner remaining on the surface of the photoconductor 1. The cleaning blade 61 or 161 may be disposed upstream from the contact portion, in the direction of movement of the surface of the photoconductor 1, where the ridge line 74*a* of the lubricant regulating blade 74 contacts the surface of the photoconductor 1. As shown in FIG. 6, the above-described cleaning blade, i.e. the cleaning blade 161 may have an obtuse angle between the backside of the faces 161*b* and 161*c* at the ridge line 161*a* thereof, which may result in a reduction of the amount of time-related abrasion of the cleaning blade 161 and a sustainment of cleaning ability of the cleaning blade 161 against age.

The above-described example embodiments are illustrative, and numerous additional modifications and variations are possible in light of the above teachings. For example, elements and/or features of different illustrative and exemplary embodiments herein may be combined with each other and/or substituted for each other within the scope of this disclosure. It is therefore to be understood that, the disclosure of this patent specification may be practiced otherwise than as specifically described herein.

Obviously, numerous modifications and variations of the present invention are possible in light of the above teachings. It is therefore to be understood that, the invention may be practiced otherwise than as specifically described herein.

What is claimed is:

1. A process cartridge detachably attachable to an image forming apparatus, the process cartridge comprising:

an image bearing member configured to bear an image on a surface thereof;

a toner cleaning device including a cleaning blade contacting a surface of the image bearing member, an edge of the cleaning blade facing opposite a rotation direction of the image bearing member; and a lubricant supplier configured to supply lubricant to the image bearing member, the lubricant supplier comprising:

a brush roller configured to contact and scrape the lubricant to apply the scraped lubricant to the surface of the image bearing member; and a lubricant regulating blade configured to regulate a depth of a layer of the lubricant applied by the brush roller to the surface of the image bearing member, and to extend in a counter blade manner opposite the rotation direction of the image bearing member, the lubricant regulating blade including:

a ridge line extending crosswise to a longitudinal axis of the image bearing member and configured to contact the surface of the image bearing member at a non-perpendicular angle to the longitudinal axis of the image bearing member;

a first face opposed to the surface of the image bearing member and located upstream from a contact portion of the ridge line and the surface of the image bearing member in a direction of movement of the surface of the image forming member; and a second face opposed to the surface of the image bearing member and located downstream from the contact portion of the ridge line and the surface of the image bearing member in the direction of movement of the surface of the image forming member, the first face and the second face intersecting at the ridge line, an inner surface of the first face and an inner surface of the second face forming an obtuse angle therebetween;

wherein the cleaning blade, the brush roller, and the lubricant regulating blade are formed in this order upstream to downstream relative to the rotational direction of the image bearing member.

2. The process cartridge according to claim 1, wherein the obtuse angle of the ridge line ranges from approximately 95 degrees to approximately 140 degrees.

3. An image forming apparatus, comprising:

an image bearing member configured to bear an image on a surface thereof;

a charging device configured to uniformly charge the surface of the image bearing member;

an optical writing device configured to optically form a latent image on the surface of the image bearing member charged by the charging device;

a developing device configured to develop the latent image formed on the surface of the image bearing member to a visible toner image;

a transfer device configured to transfer the toner image onto an image receiving member;

a toner cleaning device including a cleaning blade contacting a surface of the image bearing member, an edge of the cleaning blade facing opposite a rotation direction of the image bearing member; and a lubricant supplier configured to supply lubricant to the image bearing member, the lubricant supplier comprising:

a brush roller configured to contact and scrape the lubricant to apply the scraped lubricant onto the surface of the image bearing member; and a lubricant regulating blade configured to regulate a height of a layer of the lubricant applied by the brush roller onto the surface of the image bearing member, and to extend in a counter blade manner opposite the rotation direction of the image bearing member, the lubricant regulating blade including:

a ridge line extending crosswise to a longitudinal axis of the image bearing member and configured to contact the surface of the image bearing member at a non-perpendicular angle to the longitudinal axis of the image bearing member;

a first face opposed to the surface of the image bearing member and located upstream from a contact portion of the ridge line and the surface of the image bearing member in a direction of movement of the surface of the image forming member; and a second face opposed to the surface of the image bearing member and located downstream from the contact portion of the ridge line and the surface of the image bearing member in the direction of movement of the surface of the image forming member, the first face and the second face intersecting at the ridge line, an inner surface of the first face and an inner surface of the second face forming an obtuse angle therebetween;

wherein the cleaning blade, the brush roller, and the lubricant regulating blade are formed in this order upstream to downstream relative to the rotational direction of the image bearing member.

4. The image forming apparatus according to claim 3, wherein the obtuse angle of the ridge line ranges from approximately 95 degrees to approximately 140 degrees.

5. The image forming apparatus according to claim 3, wherein in the toner cleaning device the cleaning blade is configured to remove residual toner remaining on the surface of the image bearing member, and is disposed at a non-perpendicular angle to the longitudinal axis of the image bearing member, the cleaning blade including:

a ridge line extending crosswise to the longitudinal axis of the image bearing member and configured to contact the surface of the image bearing member at a non-perpendicular angle to the longitudinal axis of the image bearing member;

a first face opposed to the surface of the image bearing member and located upstream from a contact portion of the ridge line and the surface of the surface of the image bearing member in the direction of movement of the image bearing member; and a second face opposed to the surface of the image bearing member and located downstream from the contact portion of the ridge line and the surface of the image bearing member in the direction of movement of the surface of the image forming member, the first face and the second face intersecting at the ridge line, an inner surface of the first face and an inner surface of the second face forming an obtuse angle therebetween.

6. The image forming apparatus according to claim 3, wherein the lubricant supplier further comprises a regulating blade holder configured to hold the lubricant regulating blade downstream from a contact portion of the ridge line of the lubricant regulating blade and the surface of the image bearing member at a non-perpendicular angle to the longitudinal axis of the image bearing member.

7. The image forming apparatus according to claim 6, wherein in the toner cleaning device the cleaning blade is configured to remove residual toner remaining on the surface of the image bearing member, and is disposed at a non-perpendicular angle to the longitudinal axis of the image bearing member, the cleaning blade including:

a ridge line extending crosswise to the longitudinal axis of the image bearing member, the ridge line configured to contact the surface of the image bearing member at a non-perpendicular angle to the longitudinal axis of the image bearing member;

a first face opposed to the surface of the image bearing member and located upstream from a contact portion of the ridge line and the surface of the image bearing member in the direction of movement of the surface of the image bearing member; and a second face opposed to the surface of the image bearing member and located downstream from the contact portion of the ridge line and the surface of the image bearing member in the direction of movement of the surface of the image forming member, the first face and the second face intersecting at the ridge line, an inner surface of the first face and an inner surface of the second face forming an obtuse angle therebetween.

* * * * *